United States Patent [19]

Grünert et al.

[11] 4,364,777

[45] Dec. 21, 1982

[54] PREVENTION OF FOAM IN ALKALINE CLEANSING BATH BY THE USE OF MIXED FORMALS OF POLYGLYCOL ETHERS

[75] Inventors: Margarete Grünert, Kaarst; Karl Schmid, Mettmann; Holger Tesmann, Dusseldorf-Unterbach, all of Fed. Rep. of Germany

[73] Assignee: Henkel Kommanditgesellschaft auf Aktien (Henkel KGaa), Dusseldorf-Holthausen, Fed. Rep. of Germany

[21] Appl. No.: 257,855

[22] Filed: Apr. 27, 1981

[30] Foreign Application Priority Data

May 12, 1980 [DE] Fed. Rep. of Germany ..... 3018149

[51] Int. Cl.[3] ..... B08B 3/08; C11D 1/722

[52] U.S. Cl. ..... 134/29; 134/30; 252/174.21; 252/135; 252/156; 252/321; 252/358; 252/DIG. 1; 568/601

[58] Field of Search ..... 252/174.21, 135, 156, 252/321, DIG. 1, 358; 568/601; 134/29, 30

[56] References Cited

U.S. PATENT DOCUMENTS

| | | | |
|---|---|---|---|
| 2,905,718 | 9/1959 | Benneville et al. | 260/609 |
| 2,905,719 | 9/1959 | Benneville et al. | 260/609 |
| 2,905,720 | 9/1959 | Benneville et al. | 260/609 |
| 3,048,548 | 8/1962 | Stemple et al. | 260/611 |
| 3,334,147 | 8/1967 | Brunelle et al. | 252/89 |
| 3,382,176 | 5/1968 | Jakobi et al. . | |
| 4,070,298 | 1/1978 | Seradera et al. | 252/89 R |

FOREIGN PATENT DOCUMENTS

| | | | |
|---|---|---|---|
| 656004 | 1/1963 | Canada | 134/34 |
| 1488108 | 10/1977 | United Kingdom . | |
| 2017100 | 10/1979 | United Kingdom . | |

*Primary Examiner*—John E. Kittle
*Assistant Examiner*—Hoa Van Le
*Attorney, Agent, or Firm*—Hammond & Littell, Weissenberger and Muserlian

[57] ABSTRACT

An alkaline washing composition comprised of strongly alkaline reacting inorganic salts, optionally wetting agents and a defoaming effective amount of at least one mixed formal of an alkylpolyglycol ether having the formula:

$$R_1—O—(CH_2CH_2O)_m—CH_2—(OCH_2CH_2)_n—O—R_2$$

wherein $R_1$ is a straight or branched chain alkyl or alkenyl with from 8 to 22 carbon atoms, $R_2$ is a straight or branched chain alkyl with from 1 to 5 carbon atoms, m is a number from 2 to 30 and n is a number from 1 to 3; as well as the improvement in the process of washing rigid solid articles comprising contacting the soiled rigid solid articles with a strongly alkaline washing solution containing a defoaming effective amount of a defoaming agent, rinsing said rigid solid articles and recovering cleaned rigid solid articles, the improvement consisting of using said mixed formal as said defoaming agent.

3 Claims, No Drawings

PREVENTION OF FOAM IN ALKALINE CLEANSING BATH BY THE USE OF MIXED FORMALS OF POLYGLYCOL ETHERS

BACKGROUND OF THE INVENTION

The subject of the invention is the use of certain mixed formals of alkylpolyglycol ethers as defoaming agents in washing with strongly alkaline cleaning agents and the strongly alkaline cleaning agents containing the mixed formals of alkylpolyglycol ether defoaming agents.

Industrial cleaning agents, particularly those that are used in automatic installations for the cleaning of rigid surfaces, such as metal, ceramic or glass, as well as especially for the cleaning of bottles, are expected to have a low foaming level combined with a strong cleaning power when employed in the washing process. The industrial cleaning agents of the mentioned kind usually are products that contain strongly alkaline substances, such as especially alkali metal hydroxides or also alkali metal silicates or alkali metal orthophosphates, singly or in admixture. Such products make high demands on the defoaming agents not only with respect to the defoaming action but also with respect to the storage stability in the respective solid products.

The use of adducts of ethylene oxide and propylene oxide with compounds, such as fatty alcohols, fatty acids, polyglycerol and ethylenediamines as defoaming agents, is well known in solid as well as in liquid products for industrial cleaning.

In addition, British Pat. No. 1,488,108 discloses the use of nonionic polyglycol ether mixed formal derivatives with alcohols in alkaline reacting industrial cleansers as defoaming agents. However, it has been found that the storage stability of these polyglycol ether derivatives is not always adequate when they are included and processed into solid cleaning agents with a very high content of alkali, particularly 50% or more caustic alkali. Also desirable in the defoaming agents are a good biodegradability and stability in alkaline solutions so that they do not lose their effectiveness under sustained high temperatures during the cleaning process.

OBJECTS OF THE INVENTION

An object of the present invention is the development of a strongly alkaline industrial cleaner with a defoaming agent which is storage stable and has good biodegradability.

Another object of the present invention is the development of an alkaline washing composition comprised of strongly alkaline reacting inorganic salts, optionally wetting agents and a defoaming effective amount of at least one mixed formal of an alkylpolyglycol ether having the formula:

$$R_1—O—(CH_2CH_2O)_m—CH_2—(OCH_2CH_2)_n—O—R_2$$

wherein $R_1$ is a straight or branched chain alkyl or alkenyl with from 8 to 22 carbon atoms, $R_2$ is a straight or branched chain alkyl with from 1 to 5 carbon atoms, m is a number from 2 to 30 and n is a number from 1 to 3.

A further object of the present invention is the development of an improvement in the process of washing rigid solid articles comprising contacting the soiled rigid solid articles with a strongly alkaline washing solution containing a defoaming effective amount of a defoaming agent, rinsing said rigid solid articles and recovering cleaned rigid solid articles, the improvement consisting of using said formal as said defoaming agent.

These and other objects of the present invention will become more apparent as the description thereof proceeds.

DESCRIPTION OF THE INVENTION

Now is was found that the demands on the resistance to alkali and the dispersibility and biodegradability are met to a special degree when the mixed formals of alkylpolyglycol ethers of Formula I:

$$R_1—O—(CH_2CH_2O)_m—CH_2—(OCH_2CH_2)_n—O—R_2 \qquad \text{I}$$

in which $R_1$ represents a straight or branched chain alkyl or alkenyl with 8 to 22 carbon atoms, $R_2$ represents a straight or branched chain alkyl with 1 to 5 carbon atoms, m is a number from 2 to 30 and n is a number from 1 to 3, are used as defoaming agents in alkaline cleaning agents.

More particularly, the present invention relates to an alkaline washing composition comprised of strongly alkaline reacting inorganic salts, optionally wetting agents and a defoaming effective amount of at least one mixed formal of an alkylpolyglycol ether having the formula:

$$R_1—O—(CH_2CH_2O)_m—CH_2—(OCH_2CH_2)_n—O—R_2$$

wherein $R_1$ is a straight or branched chain alkyl or alkenyl with from 8 to 22 carbon atoms, $R_2$ is a straight or branched chain alkyl with from 1 to 5 carbon atoms, m is a number from 2 to 30 and n is a number from 1 to 3; as well as the improvement in the process of washing rigid solid articles comprising contacting the soiled rigid solid articles with a strongly alkaline washing solution containing a defoaming effective amount of a defoaming agent, rinsing said rigid solid articles and recovering cleaned rigid solid articles, the improvement consisting of using said mixed formal as said defoaming agent.

Especially suitable proved to be the use of those compounds of Formula I in which $R_1$ represents an alkyl with 12 to 18 carbon atoms, $R_2$ represents an alkyl with 2 to 4 carbon atoms, m is a whole number from 7 to 15, and n is equal to 1. The mixed formals of the alkylpolyglycol ethers of the formula given above that are to be used can be prepared, for example, by reacting an ethoxylate of fatty alcohols of the formula:

$$R_1—O—(CH_2CH_2O)_mH$$

with an excess dialkylglycol formal of the formula:

$$R_2—O—(CH_2CH_2O)_n—CH_2—(OCH_2CH_2)_n—O—R_2$$

in the presence of a strong acid such as sulfuric acid, by heating to temperatures from 60° C. to about 150° C. for several hours. $R_1$ and $R_2$, as well as m and n, have the same significance here as given in Formula I.

Preparation of the compounds of Formula I are more particularly described in related commonly assigned U.S. Patent Appln. Ser. No. 257,632, filed concurrently herewith and incorporated herein by reference.

Suitable as starting products for the ethoxylates of fatty alcohols are straight or also branched chain aliphatic alcohols, such as hexadecyl, tetradecyl and octadecyl alcohols as well as the corresponding branched iso-alcohols. Suitable as branched aliphatic alcohols are also those that can be prepared by the so-called Guerbet reaction (dimerization of primary alcohols). However, synthetic fatty alcohols or mixtures of these, as they are obtained by oxosynthesis, also may be used.

The highly alkaline cleaning agents (pH more than 10) contain especially sodium or potassium hydroxide. However, other strongly alkaline substances, such as alkali metal carbonates and alkali metal orthophosphates, alone or in combination with alkali metal hydroxides, are also used. The alkaline cleaning agents also may contain the usual components, such as alkali metal silicates, alkali metal borates, polymeric alkali metal phosphates and/or complexing agents, such as organic phosphonic acids, especially 1-hydroxy-ethane-1,1-diphosphonic acid, aminotrimethylenephosphonic acid, or 2-phosphonobutan-1,2,4-tricarboxylic acid.

The molar ratio of $Na_2O$ or $K_2O:P_2O_5$ can be 1:1 to 2:1 for the polymeric phosphates. Sodium tripolyphosphate is especially preferred.

Powdered, synthetically prepared aluminosilicates that are insoluble in water and contain water of hydration and have the general formula:

$$(Kat_{2/n}O)_x.Al_2O_3.(SiO_2)_y$$

in which Kat represents a cation with the valence n exchangeable with calcium, preferably sodium, x is a number from 0.7 to 1.5, preferably 0.9 to 1.3, and y is a number from 0.8 to 6, preferably from 1.3 to 4, which have a calcium-binding capacity of 50 to 200, preferably 100 to 200, mg CaO/gm of the anhydrous active aluminosilicate, also may be used as substitutes for the polyphosphates. Preferred are the crystalline sodium aluminosilicates, especially Zeolite A and Zeolite X.

In special cases, anionic tensides or surfaceactive compounds that are resistant to alkalies, such as alkyl sulfonates and/or arylsulfonates, are also suitable as constituents.

The mixed formal of an alkylpolyglycol ether is customarily employed in the alkaline washing compositions in amounts of from 0.2% to 15% by weight of the total alkaline washing composition.

The added amount of defoaming agent is about 0.1 to 1 gm/liter based on the solution to be used. The amount added depends on the desired defoaming action and on the contaminants or the bath concentration of the cleaning agent. The cleaning agents generally are used in a bath concentration of 0.2% to 10%, depending on the purpose for which they are intended. The temperature of the bath generally is between 40° C. and 90° C.

The following examples are illustrative of the practice of the invention without being limitative thereto.

EXAMPLE 1

Various cleaning agents, as they are used particularly for washing bottles, were prepared by intensive mixing of the constituents. These had the following composition:

(a)
75.0% Technical grade sodium hydroxide flakes,
6.0% Sodium tripolyphosphate,
15.5% Sodium metasilicate.$5H_2O$, as well as
3.5% of the defoaming agent to be tested.

(b)
15.0% Sodium hydroxide,
25.0% Sodium tripolyphosphate,
25.0% Sodium metasilicate,
32.0% Sodium carbonate
3.0% of the defoaming agent to be tested.

The cleaning agents prepared in this manner were stored at 45° C. in closed polypropylene containers, and the defoaming tests were performed at intervals of two weeks each.

The cleaning mixture was added in an amount of 1.5% to an aqueous 0.025% solution of soft soap or to an aqueous 0.025% solution of alkylbenzene sulfonate for the tests. Sample quantities of 500 ml of these solutions were then tested by the free-fall circulating method, and the foam values were determined.

The free-fall circulating method consists of the heating of 500 ml of cleaning solution to 60° C. in a 2-liter graduated cylinder with a heating jacket. This solution is circulated continuously with the aid of a pump at a rate of 4 liters/minute, by sucking the solution with a glass tube from the bottom of the graduated cylinder and returning it by gravity through a second glass tube that is level with the 2,000-ml line of the graduated cylinder. A constant outlet foam volume (for example, 2,000 ml) is established after a short time with this method. The resulting total volumes of foam and solution were read at intervals of 1, 3, 5, 10, 20 and 30 minutes.

The products that are unstable or of only limited stability after several weeks of storage either do not have a foam-reducing effect or their foam depression falls off considerably after a short time, within 10 to 30 minutes, for example. Stable products maintain a practically constant defoaming activity from the beginning to the end of the testing period (30 minutes). With unstable products, the foam reaches its maximal height, for example, 2,000 ml, after only a few minutes.

The following table shows the stability and defoaming action of the products according to the invention in comparison with similar commercial products.

TABLE

| No. | Mixed Formal of: | Defoaming Action | Stability in Alkali |
|---|---|---|---|
| 1. | $C_{12-18}$—fatty alcohol + 9 EO and n-butanol | Satisfactory | 2 weeks |
| 2. | $C_{12}/C_{14}$—fatty alcohol + 10 EO and butanol | Good | 2 weeks |
| 3. | Glycerol + 30 EO and hexaoxypropylene glycol | Satisfactory | 2 weeks |
| 4. | Trimethylolpropane + 30 EO and hexaoxypropylene glycol | Poor | — |
| 5. | $C_{12-18}$—fatty alcohol + 9 EO and butoxyethanol | Good | 14 weeks |
| 6. | $C_{12-18}$—fatty alcohol + 7 EO and n-butoxyethanol | Good | 14 weeks |
| 7. | Guerbet alcohol $C_{20}$ + 15 EO and n-butoxyethanol | Good | 8 weeks |
| 8. | $C_{14}/C_{15}$—oxoalcohol + 7 EO and n-butoxyethanol | Good | 14 weeks |
| 9. | $C_{14}/C_{15}$—oxoalcohol + 11 EO and n-butoxyethanol | Good | 8 weeks |

EO = Ethylene oxide

Nos. 1 to 4 are comparison products.

Nos. 1 and 2 were produced analogously as described in Examples 1 to 6 of British Pat. No. 1,488,108.

Nos. 5 to 9 were produced analogously as described in Examples 14 to 19 of copending commonly assigned U.S. Patent Appln. Ser. No. 257,632, filed concurrently herewith.

EXAMPLE 2

An agent for the steam-jet cleaning of metal surfaces had the following composition:

51.0% Water,
5.0% Saturated fatty acids ($C_8/C_{10}$),
8.0% Mixed formal of $C_{12-18}$-fatty alcohol+9 EO with n-butyoxyethanol,
26.0% Potassium hydroxide (38% aqueous solution),
10.0% Potassium pyrophosphate.

A clear, mixed product with extremely weak foaming was obtained, which is used as a 1% solution.

EXAMPLE 3

An alkaline cleaning granulate for the degreasing of metal surfaces was dry-mixed and had the following composition:

75.0% NaOH, granulated,
19.0% Trisodium phosphate,
3.0% Sodium tripolyphosphate,
2.0% Sodium dodecylbenzene sulfonate,
1.0% Mixed formal $C_{14}/C_{15}$ oxoalcohols+11 EO with n-butoxyethanol.

A 5% solution of this cleaning agent shows extremely weak foaming and very good degreasing action at 60° C. to 90° C.

The preceding specific embodiments are illustrative of the practice of the invention. It is to be understood, however, that other expedients known to those skilled in the art or disclosed herein may be employed without departing from the spirit of the invention or the scope of the appended claims.

We claim:

1. In the process of washing rigid solid articles with a strongly alkaline washing solution having a pH of more than 10 and containing a defoaming effective amount of a defoaming agent, rinsing said rigid solid articles and recovering cleaned rigid solid articles, the improvement consisting of using a defoaming effective amount of at least one mixed formal of an alkylpolyglycol ether having the formula $$R_1—O—(CH_2CH_2O)_m—CH_2—(OCH_2CH_2)_n—O—R_2$$

wherein $R_1$ is a straight or branched chain alkyl having from 12 to 18 carbon atoms, $R_2$ is a straight or branched chain alkyl having from 2 to 4 carbon atoms, m is a number from 7 to 15 and n is 1, as said defoaming agent.

2. The process of claim 1 wherein said mixed formal is employed in said strongly alkaline washing solution in a defoaming effective amount of from 0.1 to 1 gm per liter of washing solution.

3. The process of claim 1 wherein the temperature of said strongly alkaline washing solution is between 40° C. and 90° C.

* * * * *